US006628079B2

(12) United States Patent
Golkowski et al.

(10) Patent No.: US 6,628,079 B2
(45) Date of Patent: Sep. 30, 2003

(54) LAMP UTILIZING FIBER FOR ENHANCED STARTING FIELD

(75) Inventors: Czeslaw Golkowski, Ithaca, NY (US); David Hammer, Ithaca, NY (US); Byungmoo Song, Ithaca, NY (US); Yonglai Tian, Fairfax, VA (US); Miodrag Cekic, Bethesda, MD (US); Michael G. Ury, Barrington, MA (US); Douglas A. Kirkpatrick, Great Falls, VA (US)

(73) Assignees: Cornell Research Foundation, Inc., Ithaca, NY (US); Fusion UV Systems, Inc., Gaithersburg, MD (US); Fusion Lighting, Inc., Rockville, MD (US)

( * ) Notice: Subject to any disclaimer, the term of this patent is extended or adjusted under 35 U.S.C. 154(b) by 0 days.

(21) Appl. No.: 09/838,234

(22) Filed: Apr. 20, 2001

(65) Prior Publication Data

US 2002/0140381 A1 Oct. 3, 2002

Related U.S. Application Data

(60) Provisional application No. 60/199,810, filed on Apr. 26, 2000.

(51) Int. Cl.[7] ..... H01J 25/50; H01J 1/50

(52) U.S. Cl. ..... 315/39.51; 313/160

(58) Field of Search ..... 315/248, 39, 39.51; 313/17, 18, 34, 39, 160, 634

(56) References Cited

U.S. PATENT DOCUMENTS

| | | | | | |
|---|---|---|---|---|---|
| 4,047,064 | A | | 9/1977 | Cosco et al. | 313/201 |
| 4,393,100 | A | * | 7/1983 | Potter | 427/181 |
| RE32,626 | E | | 3/1988 | Yoshizawa et al. | 315/39 |
| 4,890,042 | A | * | 12/1989 | Witting | 315/248 |
| 5,578,901 | A | * | 11/1996 | Blanchet-Fincher et al. | 313/496 |
| 5,683,949 | A | * | 11/1997 | Scott et al. | 501/86 |
| 5,686,793 | A | | 11/1997 | Turner et al. | 313/570 |
| 5,729,090 | A | * | 3/1998 | Scott et al. | 313/637 |
| 5,834,895 | A | * | 11/1998 | Dolan et al. | 313/570 |
| 5,847,517 | A | * | 12/1998 | Ury et al. | 315/248 |
| 5,866,980 | A | * | 2/1999 | Dolan et al. | 313/570 |
| 5,977,712 | A | * | 11/1999 | Simpson | 315/39 |
| 6,084,348 | A | * | 7/2000 | Love | 313/567 |
| 6,110,527 | A | * | 8/2000 | Brun et al. | 427/214 |
| 6,316,875 | B1 | * | 11/2001 | Kirkpatrick et al. | 313/633 |

FOREIGN PATENT DOCUMENTS

| | | | |
|---|---|---|---|
| EP | 0 002 848 | 7/1979 | H01J/61/54 |
| JP | 57-055057 | 4/1982 | |
| JP | 57-152663 | 9/1982 | |
| JP | 57-202644 | 11/1982 | |
| JP | 58-005960 | 1/1983 | |
| WO | 98/56213 | 12/1998 | H05B/37/00 |
| WO | 99/08865 | 2/1999 | B31F/1/07 |
| WO | 00/30142 | 5/2000 | H01J/17/16 |

* cited by examiner

*Primary Examiner*—Don Wong
*Assistant Examiner*—Minh D A
(74) *Attorney, Agent, or Firm*—Antonelli, Terry, Stout & Kraus, LLP

(57) ABSTRACT

A discharge lamp bulb includes a light transmissive envelope and at least one conductive fiber disposed on a wall of the envelope, where the fiber has a thickness of less than 100 microns. The lamp may be either electrodeless or may include internal electrodes. Suitable materials for the fiber(s) include but are not limited to carbon, silicon carbide, aluminum, tantalum, molybdenum, platinum, and tungsten. Silicon carbide whiskers and platinum coated silicon carbide fibers may also be used. The fiber(s) may be aligned with the electrical field, at least during starting. The lamp preferably further includes a protective material covering the fiber(s). For example the protective material may be a sol gel deposited silica coating. Noble gases inside the bulb at pressures in excess of 300 Torr can be reliably ignited at applied electric field strengths of less than $4\times10^5$ V/m. Over 2000 Torr xenon, krypton, and argon respectively achieve breakdown with an applied field of less than $3\times10^5$ V/m.

76 Claims, 8 Drawing Sheets

LAMP UTILIZING FIBER FOR ENHANCED STARTING FIELD

BACKGROUND

1. Field of the Invention

The invention relates generally to discharge lamps. The invention relates more specifically to novel starting aids for discharge lamps. The invention also relates to novel methods for making discharge lamps with novel starting aids.

2. Related Art

It is well known in the discharge lamp art that igniting a plasma discharge can be difficult. For most discharge lamps, the fields required to achieve ignition of the plasma are much higher than the fields required to bring the lamp up to full output and thereafter maintain a stable discharge.

Many patents describe different devices and methods for assisting the starting of discharge lamps. The prior art considered most relevant to the present invention includes U.S. Pat. No. RE32,626 and its related Japanese patent publication nos. 57-55057, 57-152663, 57-202644, and 58-5960. These publications disclose a relatively thick (e.g. 0.5 to 1 mm diameter) wire encapsulated in quartz and disposed inside an electrodeless lamp bulb for enhancing starting fields. However, numerous problems occur with the use of a thick wire inside a discharge lamp envelope. For example, it is difficult to protect the wire against the heat and reactivity of the plasma. A thick wire does not readily conform to the envelope wall, thus compounding the difficulty of protecting the wire from the plasma. Also, a thick wire blocks an appreciable portion of the light output and may even cast an undesirable shadow. All of the disclosed configurations are believed to suffer from significant coupling of energy to the starting wire which results in distortion of the plasma and eventual overheating of the wire.

SUMMARY

One object of the invention is to provide field enhancement inside a discharge lamp envelope during starting to aid in the breakdown of an inert gas disposed as a fill material inside the envelope. An advantage of the invention is that for the same applied field such breakdown may be achieved at fill pressures which are higher than can be achieved without the present invention. A corresponding advantage is that a fill at a given pressure may be broken down at significantly lower power levels. While the inventors do not wish to be bound by theory of operation, it is believed that the present invention also provides advantages of increased lamp efficiency, reduced start and re-strike times, longer lamp life, and reduced stress on the RF source. Other potential advantages are believed to include bulb ignition without the need for external ignition devices, improved light output and/or spectrum using fills which would otherwise be difficult to ignite, reducing the envelope wall temperature by using low thermal conductivity gases (higher atomic number), and providing "instant on" lighting by utilizing fill materials which are always in a gaseous state (e.g. $SO_2$ gas). Another advantage is believed to include ignition of the inert gas without the use of radioactive starting aids (e.g. $Kr_{85}$). Of course, discharge lamps utilizing principles of the invention will not necessarily provide all of the foregoing advantages, depending on the particular configuration and application.

One aspect of the present invention is achieved by a lamp bulb which includes a light transmissive envelope and at least one conductive or semi-conductive fiber disposed on the light transmissive envelope, where the at least one fiber is of a suitable material and is disposed in a suitable orientation to provide an enhanced starting field (e.g. a higher electrical field strength during starting). For example, the fiber may comprise a material or combination of materials selected from the group of carbon (e.g. graphite), silicon carbide (SiC), molybdenum, platinum (Pt), tantalum, and tungsten (W), and preferably has a thickness of 100 microns or less and may even be of sub-micron thickness. Aluminum may also be used, but is not preferred with quartz envelopes because aluminum reacts with $SiO_2$ and causes devitrification. For example, the envelope encloses an inert gas and the fibers are effective to enhance a field applied to the gas to initiate a breakdown of the gas.

The light transmissive envelope may be made of any suitable material including, for example, quartz, polycrystalline alumina (PCA), and sapphire. Quartz is generally preferred for low cost applications.

The use of an extremely fine fiber as opposed to a relatively thick wire has many potential advantages, depending on the application. For example, the fiber is generally flexible and readily conforms to the bulb wall, thus keeping the fiber out of the steady state plasma discharge. Preferably, the fiber is coincident (i.e. in thermal contact) with the bulb wall along substantially its entire length (although a coating or adhesive may be between the fiber and the bulb). Without being limited to theory of operation, the fiber may be configured with relatively high resistance during steady state operation such that energy coupled to the fiber does not generate a significant amount of heat and any heat generated is readily dissipated because the fiber is heat sunk to the bulb wall. Without being limited to theory of operation, the fiber is believed to be relatively elastic as compared to a thick wire and therefore less susceptible to thermal stresses caused, for example, by different coefficients of thermal expansion. The fiber is practically invisible to the eye and thus does not block an appreciable amount of light output or cast a noticeable shadow.

Preferably, the fiber is disposed on an inside surface of the light transmissive envelope. The fiber may optionally be covered with a protective material to inhibit interaction between a lamp fill and the fiber. For example, the protective material may comprise a sol-gel deposited silica coating. For example, the protective material comprises a silicon dioxide coating less than 2 microns thick.

According to another aspect of the invention, a plurality of conductive or semi-conductive fibers are disposed on the lamp envelope.

According to another aspect of the invention, the fibers include silicon carbide whiskers.

According to another aspect of the invention, the fibers include platinum coated silicon carbide fibers.

According to another aspect of the invention, the fibers comprise a plurality of closely spaced parallel fibers. Alternatively, the fibers comprise a plurality of randomly distributed fibers. For example, each of the fibers is about 3 mm long or less.

According to another aspect of the invention, a discharge apparatus includes a light transmissive container having a light emitting fill disposed therein; a coupling structure adapted to couple energy to the fill in the container; a high frequency source connected to the coupling structure; and at least one fiber disposed on a wall of the container, wherein each of the fibers has a thickness of less than 100 microns, wherein the fibers are made from a conductive material, a semi-conductive material, or a combination of conductive and semi-conductive materials. The fibers are sufficiently flexible to readily conform to the wall of the container. For example, the fill includes an inert gas and the fibers are effective to enhance a field applied to the gas to initiate a breakdown of the gas. For example, the fill comprises a noble gas at a pressure greater than 300 Torr, the field applied to the bulb during starting is less than $4\times10^5$ V/m, and the applied field is effective to cause a breakdown of the noble gas.

In some examples, the high frequency source comprises a magnetron and the coupling structure comprises a waveguide connected to a microwave cavity. Preferably, at least one fiber is aligned with the electric field during starting. The apparatus may be a lamp and the container may comprise a sealed electrodeless lamp bulb. For example, the electrodeless lamp bulb comprises a linear bulb and the fibers comprise a plurality of fibers concentrated at respective ends of the linear bulb.

According to another aspect of the invention, a method of making a discharge lamp bulb includes providing a light transmissive envelope; and securing a fiber on a wall of the envelope. For example, securing the fiber comprises patterning the fiber on the wall with photolithography. Alternatively, securing the fiber comprises depositing the fiber inside the envelope and adhering the fiber to the wall of the envelope with a sol-gel solution. The method may further include covering the fiber with a protective material. For example, the protective material comprises silica and the covering comprises coating the fiber with a sol-gel solution.

The foregoing and other objects, aspects, advantages, and or features of the invention described herein are achieved individually and in combination. The invention should not be construed as requiring two or more of such features unless expressly recited in a particular claim.

BRIEF DESCRIPTION OF THE DRAWINGS

The foregoing and other objects, features, and advantages of the invention will be apparent from the following more particular description of preferred embodiments as illustrated in the accompanying drawings, in which reference characters generally refer to the same parts throughout the various views. The drawings are not necessarily to scale, the emphasis instead being placed upon illustrating the principles of the invention.

DESCRIPTION

Figure 1:
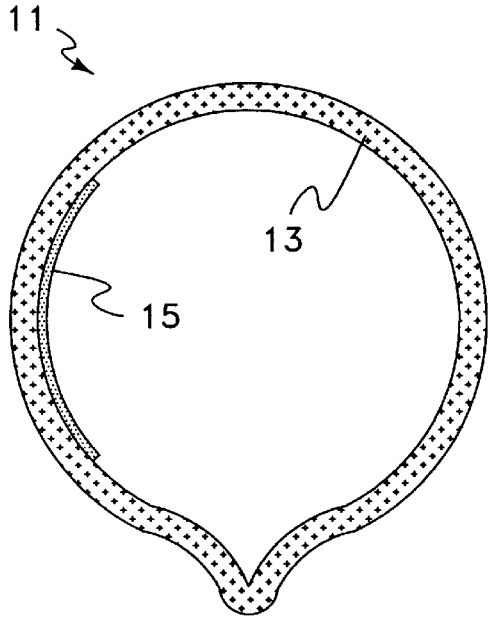
FIG. 1 is a schematic cross sectional view of a first example of a discharge lamp bulb including a starting aid in accordance with the present invention.

In the following description, for purposes of explanation and not limitation, specific details are set forth such as particular structures, interfaces, techniques, etc. in order to provide a thorough understanding of the present invention. However, it will be apparent to those skilled in the art having the benefit of the present specification that the invention may be practiced in other embodiments that depart from these specific details. In certain instances, descriptions of well known devices, circuits, and methods are omitted so as not to obscure the description of the present invention with unnecessary detail.

RF or microwave powered electrodeless lamps are well known in the art to be more difficult to start than their electroded counterparts because of the absence of internal electrodes. Of course, internal electrodes have their own disadvantages in terms of limiting the lamp life and the choice of compatible fills.

As used herein, lamp "ignition" refers to a condition in which a sustained electrical discharge forms within a lamp envelope. After ignition is achieved the discharge will typically expand and dissipate increasing amounts of RF energy until a stable discharge is sustained. The shape and size of the discharge depend on the bulb envelope and the mode of excitation of the plasma. "Run up" refers to the time between lamp ignition and the time when a stable discharge producing full light output is achieved. The time between the application of RF energy and lamp ignition is referred to herein as "delay" time. "Re-strike" refers to the time between when RF energy is removed from the lamp until the time when the lamp can be ignited again. Typical re-strike times in conventional discharge lamps range anywhere from tens of seconds to tens of minutes.

During the delay time and through the run up time after ignition, the RF source is typically not well matched to the lamp and significant amounts of RF power are reflected back to the source. To reduce the potential for thermal and/or voltage standing wave ratio (VSWR) damage to the power source, it is desirable to reduce the delay and run up time, especially for discharge lamp systems which require frequent starts.

Conventional electrodeless lamps typically include an inert gas as one of the fill constituents. The inert gas ionizes and heats the walls of the lamp envelope which in turn vaporizes any solid fill materials which produce the desired light spectrum. For microwave excited electrodeless lamps with a spherical bulb of about 30 mm diameter, the run up process typically takes on the order of 10 to 40 seconds for a low pressure (e.g. 50 Torr) argon discharge. Higher pressure gases typically are more difficult to ignite, but run up faster once ignited.

Inert fill gases with higher atomic numbers (e.g. xenon) are also typically more difficult to ignite as compared to similar fill pressures of inert gases with lower atomic numbers. However, once the discharge has stabilized the higher atomic number gases provide better thermal insulation between the discharge and the bulb, thereby reducing heat transfer from the plasma to the wall of the bulb and increasing efficiency of operation. The reduced heat transfer allows higher power densities to be applied because the bulb walls are relatively cooler.

Both UV and visible lamps may be configured with fills that are always in a gaseous state. For example, high pressure xenon discharges (e.g. about 1 atmosphere or more) produce significant amounts of visible and UV light. An excimer lamp may include a high pressure xenon and a chlorine gas mixture. Sulfur dioxide ($SO_2$) is another example of a completely gaseous fill which produces a visible light discharge. Once ignited, these types of fills produce a sufficiently high initial light output to be considered "instant on" light sources. Such instant on light sources are preferable for many visible lighting applications including general lighting, automotive lighting, and theatrical lighting, and also numerous UV processing applications.

A sufficiently high field enhancement may permit instant re-strike of a hot extinguished bulb fill, thus eliminating the minutes usually waited until the pressure drops in the bulb. In any event, higher fields permit faster re-strike.

With reference to FIG. 1, a discharge lamp bulb 11 includes a light transmissive envelope 13 with a conductive or semi-conductive fiber 15 disposed on an inside surface of the envelope 13. The fiber 15 is substantially coincident with the bulb wall along the entire length of the fiber 15. In other words, the fiber 15 is heat sunk to (i.e. in thermal contact with) the envelope 13 along substantially its entire length. In application the envelope 13 is preferably positioned such that the fiber 15 is aligned to couple to the applied electric field. Without being limited by theory of operation, it is believed that the fiber 15 should be sufficiently conductive so that the applied E field can move enough charge to either end of the fiber to create a field enhancement during starting but not so conductive that it significantly affects steady state operation.

For example, in a spherical envelope 13 having a 35 mm outer diameter the fiber 15 may comprise a 10 micron diameter graphite fiber having a length of 20 mm. In general, the fibers described herein have circular cross sections (perpendicular to the lengthwise axis) and the applicable dimensions for the thickness of the fiber is the diameter. However, fibers having any useful shape may be used. For fibers having a cross section other than circular, the applicable dimension for the thickness of the fiber is the thinnest dimension for any possible cross section perpendicular to the lengthwise axis of the fiber. Non-circular cross section fibers may be beneficial for particular application in terms of bonding the fiber to the wall or having a thinner profile for field enhancement.

Figure 2:
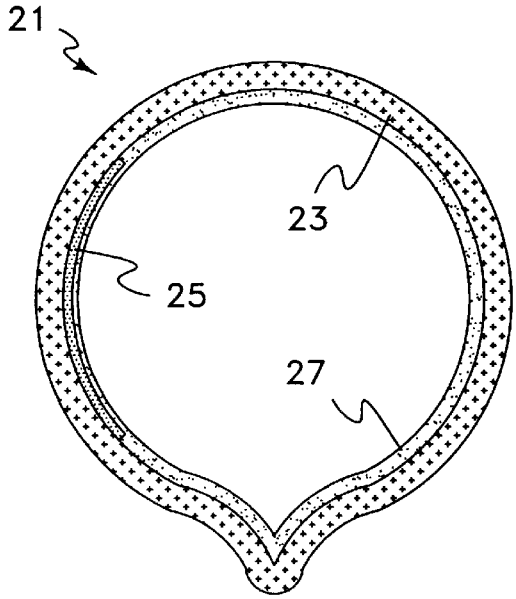
FIG. 2 is a schematic cross sectional view of a second example of a discharge lamp bulb including a starting aid in accordance with the present invention.

With reference to FIG. 2, a discharge lamp bulb 21 includes a light transmissive envelope 23 with a conductive or semi-conductive fiber 25 disposed on an inside surface of the envelope 23. The bulb 21 further includes a protective material 27 covering the fiber 25.

Figure 3:
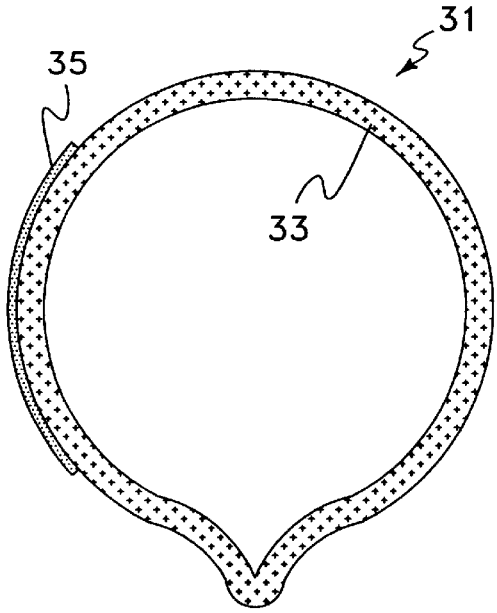
FIG. 3 is a schematic cross sectional view of a third example of a discharge lamp bulb including a starting aid in accordance with the present invention.

With reference to FIG. 3, a discharge lamp bulb 31 includes a light transmissive envelope 33 with a conductive or semi-conductive fiber 13 disposed on an outside surface of the envelope 33. The fiber 13 is substantially coincident with the bulb wall along the entire length of the fiber 35.

Figure 4:
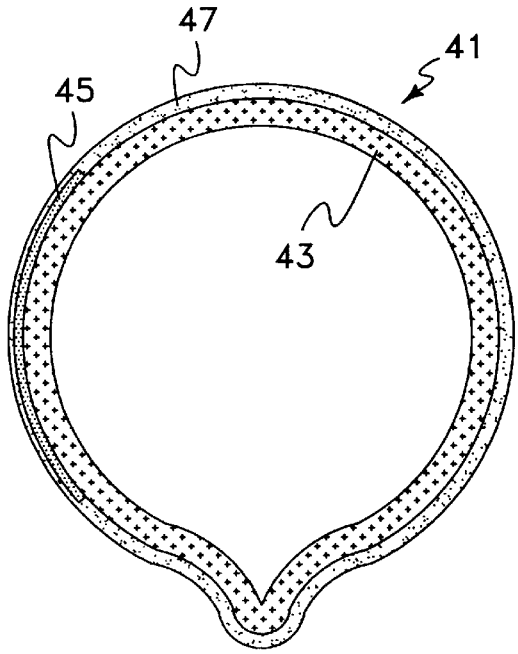
FIG. 4 is a schematic cross sectional view of a fourth example of a discharge lamp bulb including a starting aid in accordance with the present invention.

With reference to FIG. 4, a discharge lamp bulb 41 includes a light transmissive envelope 43 with a conductive or semi-conductive fiber 45 disposed on an outside surface of the envelope 43. The bulb 41 further includes a protective material 47 covering the fiber 45.

Figure 5:
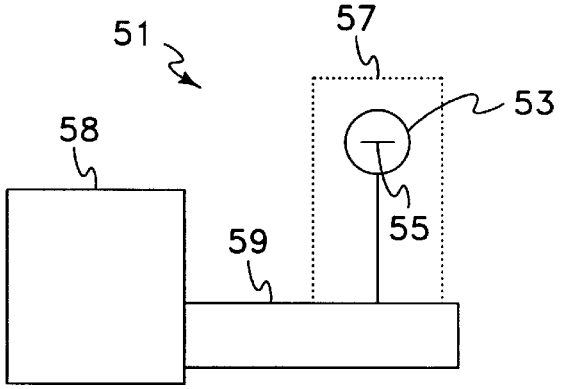
FIG. 5 is a schematic diagram of a microwave discharge lamp utilizing the novel starting aid of the present invention.

With reference to FIG. 5, a microwave discharge lamp 51 includes an electrodeless bulb 53 having a conductive or semi-conductive fiber 55 disposed on a wall of the bulb 53. Preferably the fiber 55 is disposed on an inside wall of the bulb 53 and is covered with a protective material. The bulb 53 is disposed inside a cylindrical mesh 57 which defines the microwave cavity. The cavity is configured to couple energy to the fill in the bulb 53. Microwave energy is provided from a magnetron 58 and transferred to the cavity through a waveguide 59. If necessary or desirable, the bulb 53 may be configured to rotate.

Figure 6:
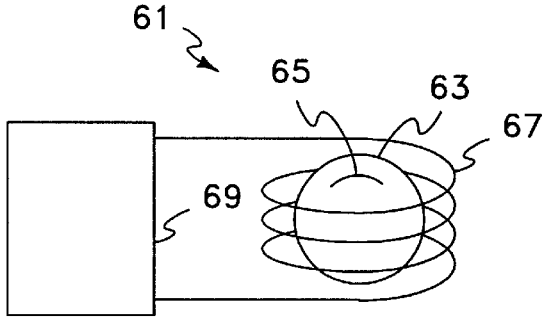
FIG. 6 is a schematic diagram of an inductively coupled discharge lamp utilizing the novel starting aid of the present invention.

With reference to FIG. 6, an inductively coupled discharge lamp 61 includes an electrodeless bulb 63 having a conductive or semi-conductive fiber 65 disposed on a wall of the bulb 63. Preferably the fiber 65 is disposed on an inside wall of the bulb 63 and is covered with a protective material. The bulb 63 is positioned proximate to an excitation coil 67 which couples energy to the fill in the bulb 63. Microwave, RF, or other high frequency energy is provided from a high frequency source 69 and is coupled to the fill by the coil 67. If necessary or desirable, the bulb 63 may be configured to rotate.

Figure 7:
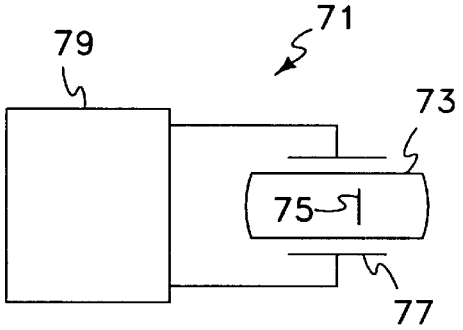
FIG. 7 is a schematic diagram of a capacitively coupled discharge lamp utilizing the novel starting aid of the present invention.

With reference to FIG. 7, an capacitively coupled discharge lamp 71 includes an electrodeless bulb 73 having a conductive or semi-conductive fiber 75 disposed on a wall of the bulb 73. Preferably the fiber 75 is disposed on an inside wall of the bulb 73 and is covered with a protective material. The bulb 73 is positioned between external electrodes of a capacitor 77 which couples energy to the fill in the bulb 73. Microwave, RF, or other high frequency energy is provided from a high frequency source 79 and is coupled to the fill by the capacitor 77. If necessary or desirable, the bulb 73 may be configured to rotate.

Figure 8:
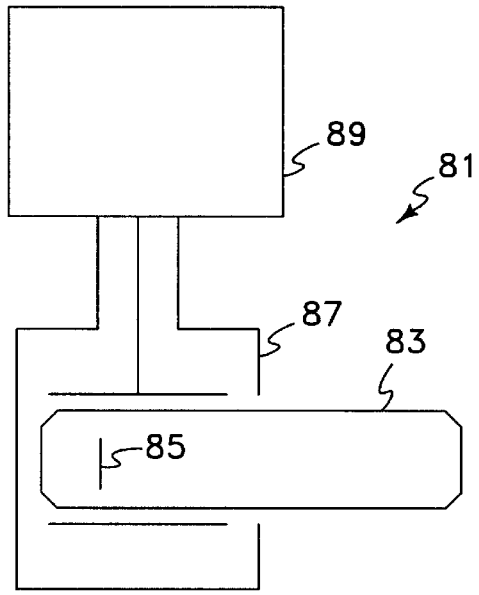
FIG. 8 is a schematic diagram of a travelling wave discharge lamp utilizing the novel starting aid of the present invention.

With reference to FIG. 8, a travelling wave discharge lamp 81 includes an electrodeless bulb 83 having a conductive or semi-conductive fiber 85 disposed on a wall of the bulb 83. Preferably the fiber 85 is disposed on an inside wall of the bulb 83 and is covered with a protective material. One end of the bulb 83 is positioned proximate to external electrodes of a travelling wave launcher 87 which couples energy to the fill in the bulb 83. Microwave, RF, or other high frequency energy is provided from a high frequency source 89 and is coupled to the fill by the launcher 87. If necessary or desirable, the bulb 83 may be configured to rotate.

Figure 9:
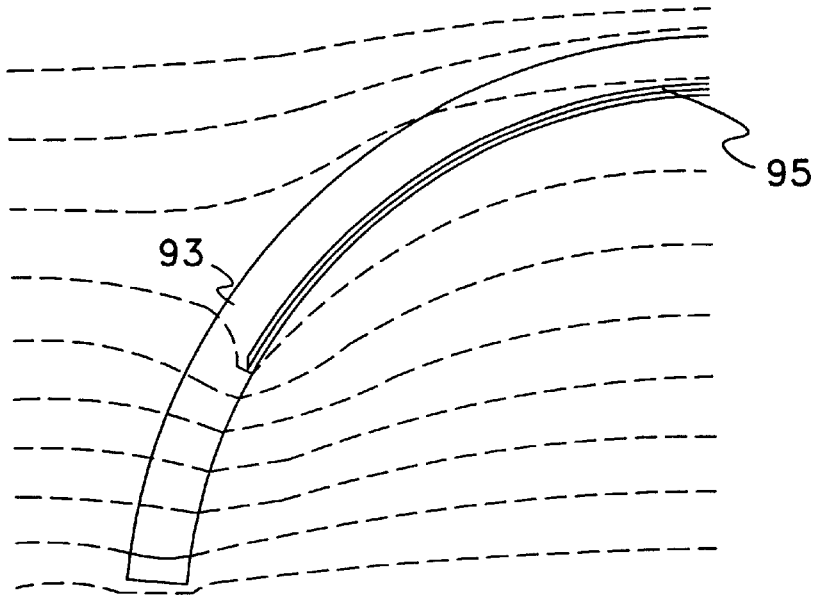
FIG. 9 is a schematic representation showing equipotential lines for a fiber on the inside of a quartz substrate.

FIG. 9 is a schematic representation showing equipotential lines (as dashed lines) for a fiber 95 on the inside of a quartz substrate 93. The graph is generated from a computer simulation of a 100 micron fiber encased in a 1 mm thick quartz substrate. Narrow spacing between the equipotential lines indicates regions of high field strength. As can be seen from FIG. 9, the fields are enhanced near the tip of the fiber 95 and high field strengths are present inside the bulb. However, the field strength outside the quartz is lower and less likely to cause breakdown of the air outside the bulb.

Figure 10:
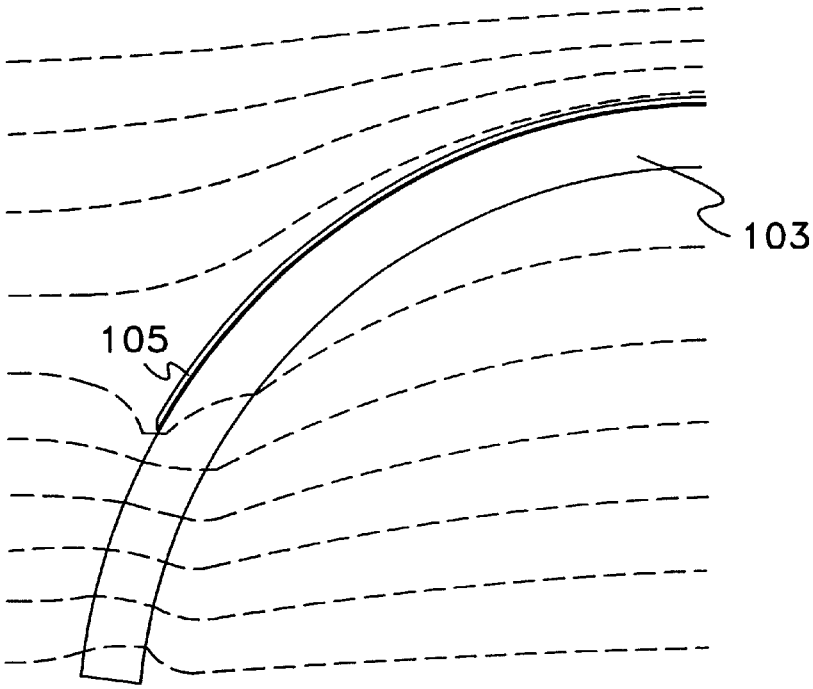
FIG. 10 is a schematic representation showing equipotential lines for a fiber on the outside of a quartz substrate.

FIG. 10 is a schematic representation showing equipotential lines for a fiber 105 on the outside of a quartz substrate 103. The graph is generated from a computer simulation of a 100 micron fiber disposed on an outside surface of a 1 mm thick quartz substrate. As can be seen from FIG. 10, the fields are concentrated outside the bulb and only a small field enhancement may be provided inside the bulb. For discharge lamps which only require a small field enhancement during starting, placement of the fiber on the outside surface of the bulb provides several advantages. Manufacturing is simplified because the fiber is readily secured in any desired position on the outer wall of the bulb. Preferably the fiber is coated with a dielectric material to reduce the potential for breakdown of the air and such coatings are more easily applied to the outer surface of the bulb as compared to the inside surface. The fiber is well insulated from the plasma discharge thus providing potentially longer useful life of the fiber.

For fills which are difficult to start, however, the fiber is preferably attached to the inside of the bulb wall and preferably positioned so that it lies in a direction to short out the applied electric field prior to ignition. In a spherical lamp the fiber may have a length about equal to a radius of the bulb envelope, thereby extending approximately 60 degrees around the lamp. With the fiber inside the bulb, the field enhancement is concentrated within the bulb and not on the outside, which exists in conventional external ignition device approaches.

Without being limited by theory of operation, it is believed that because the fiber resistance is high with respect to volume resistance of the steady state plasma, it does not couple significant energy during steady state operation. This reduces the field enhancement at the tips during steady state operation, consequently reducing plasma disturbance and over heating of the fiber during steady state operation.

For a medium pressure discharge, a boundary layer of un-ionized cool gas exists between the envelope wall and the plasma discharge. The boundary layer can vary between about 0.25 and 1 mm in thickness. Thus it is believed that the fine fiber remains outside of the steady state plasma discharge. The boundary layer also reduces heat transfer to the fiber.

Multiple Fibers

Figure 11:
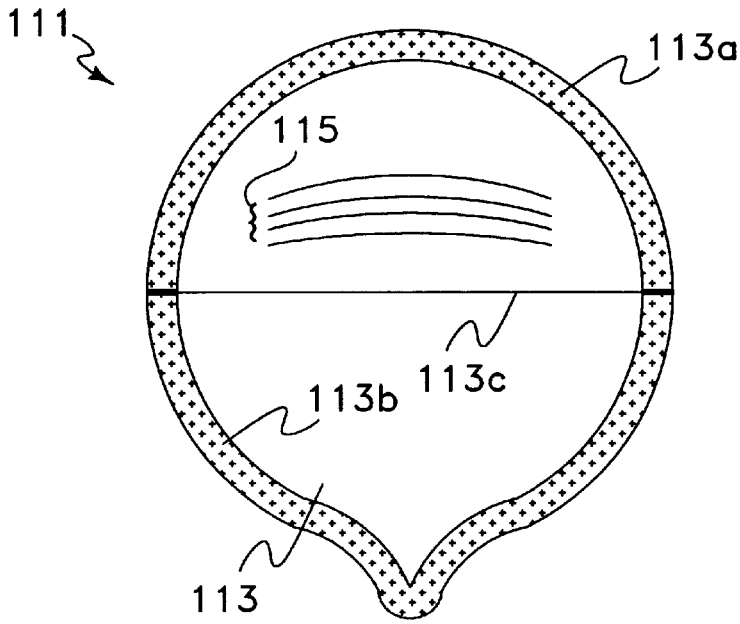
FIG. 11 is a schematic cross sectional view of a fifth example of a discharge lamp bulb including a starting aid in accordance with the present invention.

With reference to FIG. 11, a discharge lamp bulb 111 includes a light transmissive envelope 113 with a plurality of conductive or semi-conductive fibers 115 disposed on an inside surface of the envelope 113. The envelope 113 is illustrated with an alternative construction. Specifically, the envelope 113 is made from two hemispheres 113*a* and 113*b* which are joined together at a seam 113*c*. The two piece construction allows more precise positioning and/or patterning of the fibers on the interior bulb surface. However, envelope 113 may alternatively be made from single piece construction or other conventional envelope manufacturing techniques. The fibers 115 are closely spaced and parallel to each other. During operation the bulb is preferably positioned so that the fibers couple to the applied E field. Preferably, the fibers 115 are covered by a protective material such as, for example, several layers of sol-gel deposited quartz.

Figure 12:
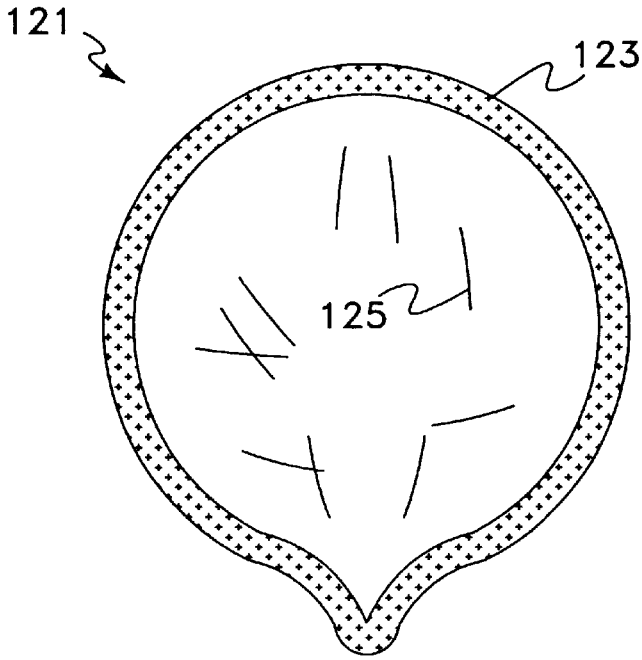
FIG. 12 is a schematic cross sectional view of a sixth example of a discharge lamp bulb including a starting aid in accordance with the present invention.

With reference to FIG. 12, a discharge lamp bulb 121 includes a light transmissive envelope 123 with a plurality of conductive or semi-conductive fibers 125 disposed on an inside surface of the envelope 123. The fibers 125 are randomly distributed along the inside surface of the envelope 123. Preferably, the fibers are covered by a protective material such as, for example, several layers of sol-gel deposited quartz. A preferred configuration is between about 100 and 200 SiC fibers, each between about 2 and 3 mm long and having a diameter of about 15 microns.

As illustrated in FIG. 12, when randomly distributed some of the fibers may overlap. At the intersection, one of the fibers is not directly in contact with the bulb wall. However, that fiber is still in thermal contact with the bulb wall for heatsinking purposes substantially along its entire length. Moreover, when coated with the sol-gel deposited protective covering, the coating substantially fills any gaps in the area of the intersection.

SiC Whiskers

Figure 13:
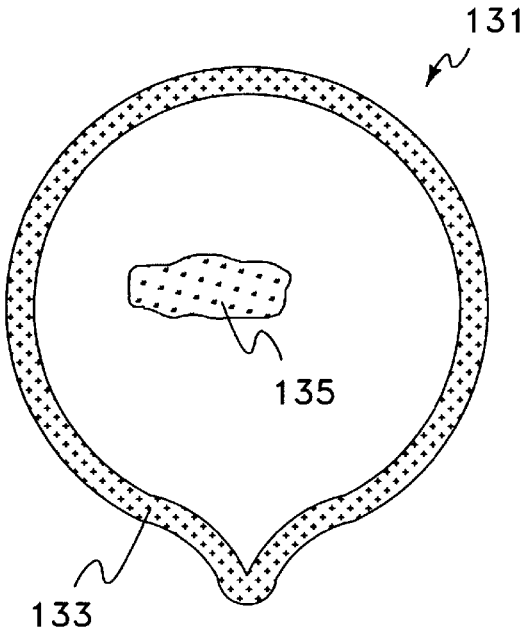
FIG. 13 is a schematic cross sectional view of a seventh example of a discharge lamp bulb including a starting aid in accordance with the present invention.

With reference to FIG. 13, a discharge lamp 131 includes a light transmissive envelope 133 with a patch of conductive or semi-conductive whiskers 135 disposed on an inside surface of the envelope 133. Preferably, the whiskers 135 are covered by a protective material such as, for example, several layers of sol-gel deposited quartz. For example, a single patch of SiC whiskers may include thousands of SiC fibers about 1 mm long or less, each having a diameter of 1 micron or less. While the inventors do not wish to be bound by theory of operation, it is believed that the improved starting results achieved with SiC whiskers may occur under different principles of operation than those involved with the other fiber initiators described herein.

Linear Bulb

Figure 14:
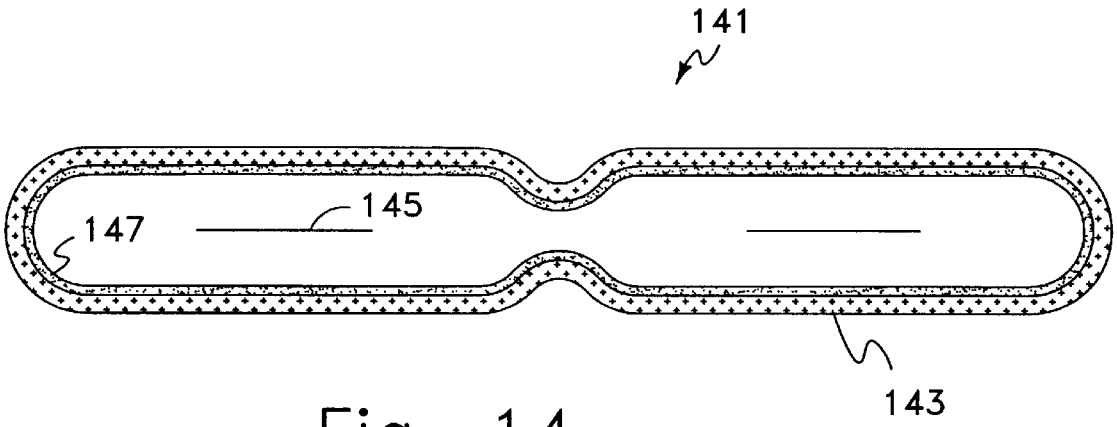
FIG. 14 is a schematic cross sectional view of an eighth example of a discharge lamp bulb including a starting aid in accordance with the present invention.

With reference to FIG. 14, a linear discharge lamp bulb 141 includes a light transmissive envelope 143 with a plurality of conductive or semi-conductive fibers 145 disposed on an inside surface of the envelope 143. The fibers 145 are aligned with the lengthwise axis of the envelope 143. As shown, the fibers 145 are covered by a protective material 147 such as, for example, several layers of sol-gel deposited quartz. The envelope 143 is cylindrical shaped with a pinched middle section. Alternative linear bulbs include straight tubes without the pinched middle section.

Figure 15:
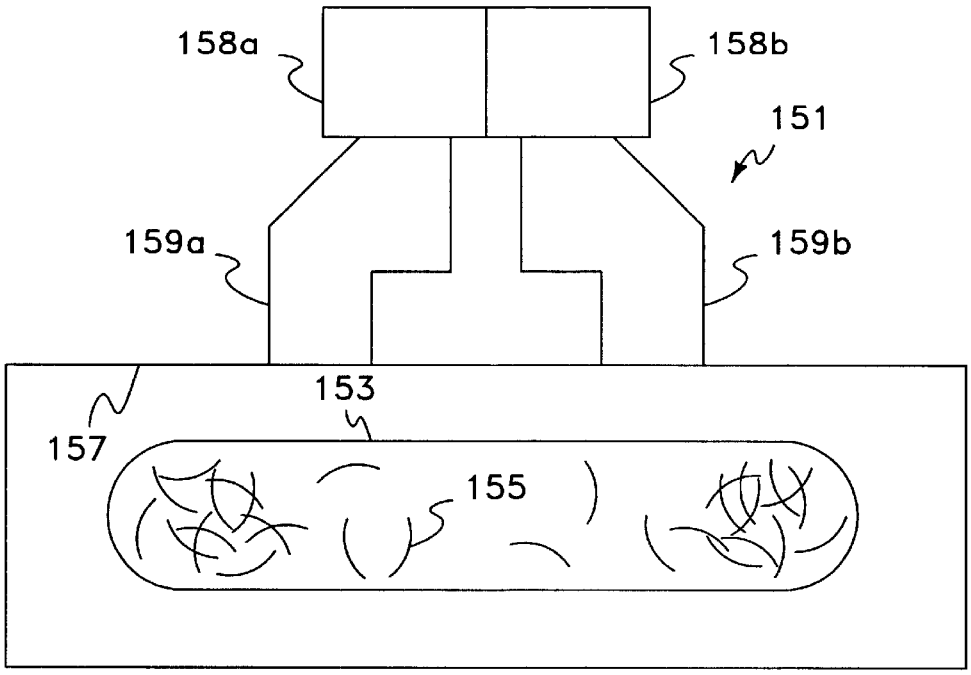
FIG. 15 is a schematic diagram of a microwave discharge lamp utilizing the novel starting aid of the present invention in a linear bulb.

With reference to FIG. 15, a discharge lamp system 151 includes an electrodeless linear bulb 153 with a plurality of conductive or semi-conductive fibers 155 distributed randomly in the bulb 153, but concentrated near the ends of the bulb 153. The bulb is disposed in a structure 157 which defines a resonant microwave cavity. Microwave energy is produced by a pair of magnetrons 158*a* and 158*b* and is provided to the fill in the bulb 153 via a coupling structure including respective waveguides 159*a* and 159*b* connected to the microwave cavity structure 157.

Arc Lamp with Internal Electrodes

Figure 16:
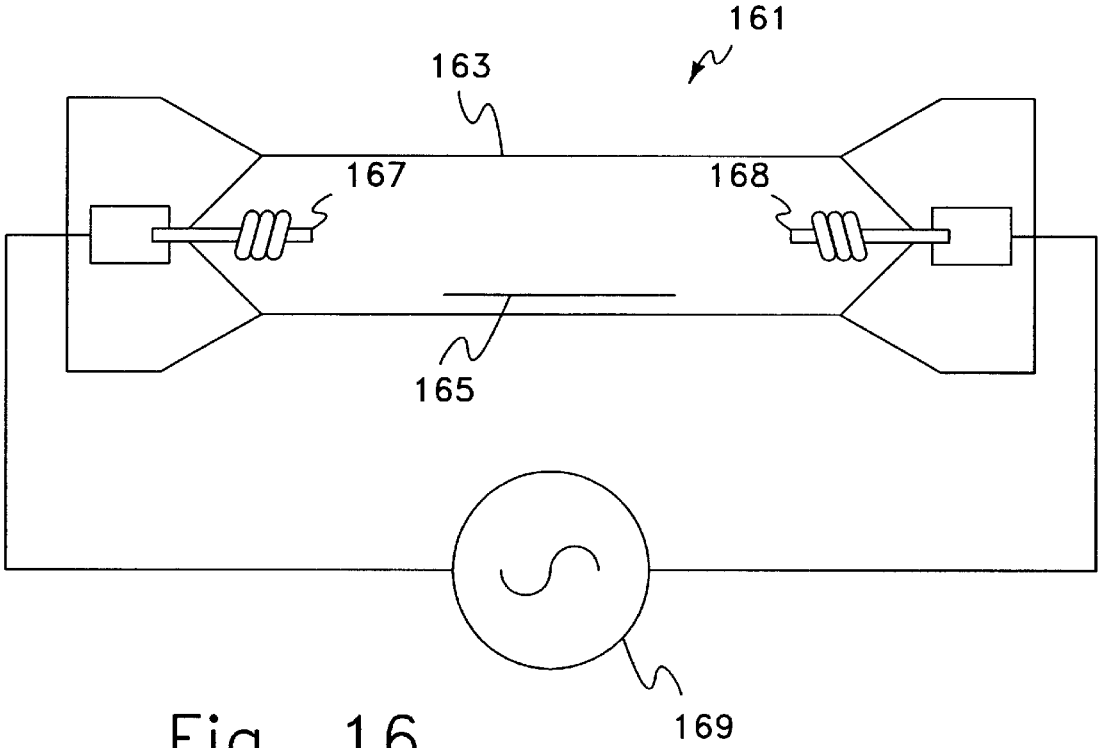
FIG. 16 is a schematic cross sectional view of an example of a discharge lamp bulb including internal electrodes utilizing the novel starting aid of the present invention.

With reference to FIG. 16, a discharge lamp 161 includes a light transmissive envelope 163 and a fiber initiator 165 disposed on an inside surface of the envelope 163. The discharge lamp 161 further includes internal electrodes 167 and 168, which are respectively connected to an alternating current (A/C) source 169. The fiber 165 is preferably aligned to couple to the applied field during starting to enhance the starting field. Preferably, the fiber is covered with a protective material such as a sol-gel deposited quartz.

Although the present invention is primarily applicable to electrodeless lamps because of the generally higher power required to start such lamps, in some applications an arc lamp with internal electrodes may benefit from the enhanced starting fields provided by the present invention. Alternative configurations include multiple fibers and SiC whiskers.

Sol-Gel Coating Process

In the preferred configurations mentioned above and in each of the examples described below, a sol gel coating process is used to secure the fiber to the inside bulb surface and/or to protect the fiber from reaction with the plasma discharge. Sol gel coating processes are well known in the art. PCT Publication No. WO 98/56213 describes various sol gel recipes and processes for coating a microwave lamp screen. PCT Publication No. WO 00/30142 describes various sol gel recipes and processes for coating an interior surface of a bulb. In general terms, the sol gel solution is formulated to yield the desired coating after evaporation of the organic solvent and higher temperature firing of the coated bulb envelope. In the present application, the desired coating is silicon dioxide ($SiO_2$).

An exemplary process according to the invention for applying the $SiO_2$ coating is as follows. A silicon dioxide precursor (e.g. TEOS) is used to prepare a sol gel solution. The sol gel solution is poured into a lamp preform and then poured out in a controlled manner to leave a relatively uniform thickness of coating behind. Alternatively, the sol gel is spin coated onto the interior surface of the bulb preform. The coating is then dried and fired. Several layers may be applied in this manner.

The fiber or fibers may be inserted into the bulb preform before the sol gel solution is added. Alternatively, the fiber or fibers may be added to the sol gel solution before the sol gel is poured into the preform and the sol gel is used to carry the fiber(s) into the bulb. The solution with the fiber(s) is then spun, shaken, or otherwise agitated to dispose the fiber(s) against the inside bulb surface. The drying and firing process then secures the fiber(s) in place. When secured in this manner, a thin layer of the coating may be between the fiber and the bulb wall. However, for heatsinking purposes the fiber(s) are in good thermal contact with the bulb wall over substantially the entire length of the fiber(s). Several additional sol gel layers may be added without any fibers to ensure that the fibers are sufficiently coated.

With a high rotation speed, centrifugal force acts on a single long fiber to dispose the fiber along the equator (relative to the axis of rotation). A lower rotation speed forces the fiber(s) against the wall, but with a more random orientation. Shaking or agitating the bulb also provides a more random distribution of the fiber(s).

Exemplary sol gel recipe for a quartz thin film coating are as follows (expressed as ranges of mole ratios):

| RANGE | TEOS | EtOH | $H_2O$ | HCl |
|---|---|---|---|---|
| General | 1 | 1–4 | 0–5 | 0.1–0.3 |
| No cracking | 1 | 1–3 | 0.5–1.5 | 0.1–0.3 |
| Preferred | 1 | 3 | 1 | 0.15 |

where:
TEOS: Tetraethoxysilane-$Si(0C_2H_5)_4$
EtOH: Ethanol-$C_2H_5OH$

In general, it is believed that the resulting $SiO_2$ layer thickness is on the order of 0.2 microns. Several layers may be applied and the resulting thickness is still less than 1 to 2 microns. Without being limited by theory of operation, it is believed that the coating is preferably thick enough to inhibit reaction between the plasma and the fiber and thin enough to facilitate the desired field enhancement. Depending on the applied starting field strength, between 2 and 4 layers of sol-gel applied coating are preferred.

Platinum Coated Silicon Carbide Fibers

Figure 17:
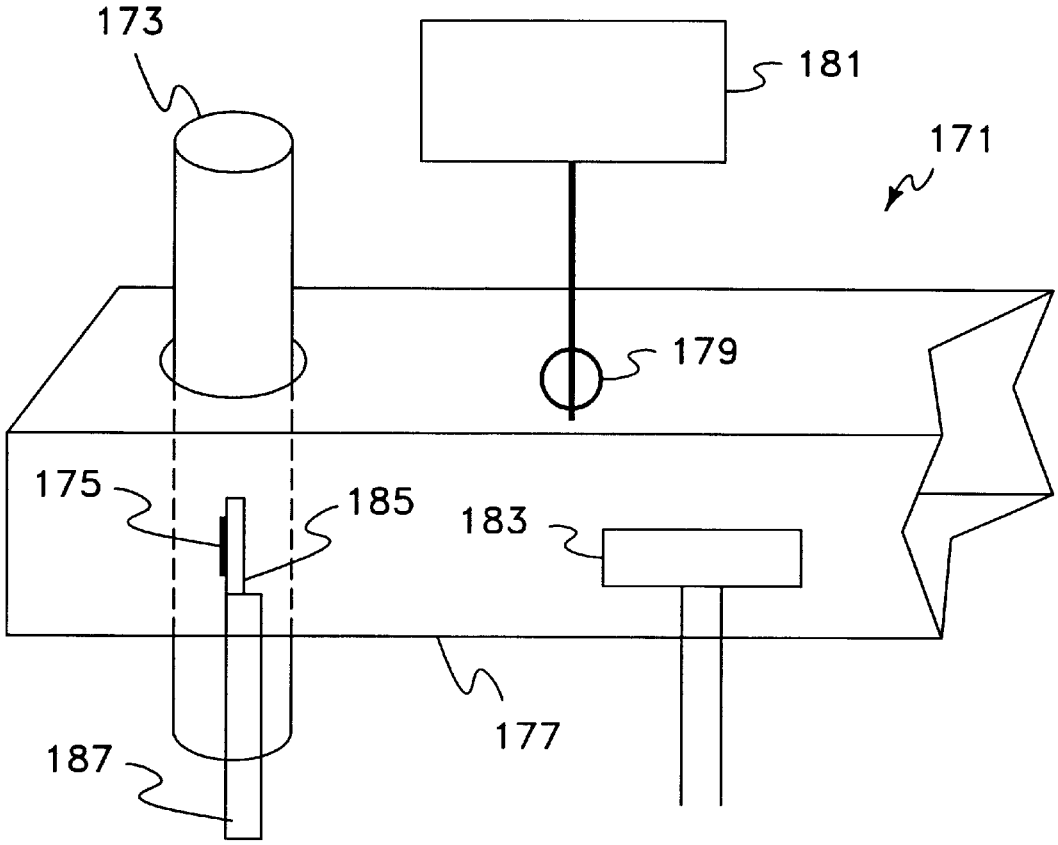
FIG. 17 is a fragmented, partially perspective, partially schematic view of an apparatus utilizing principles of the invention.
Figure 18:
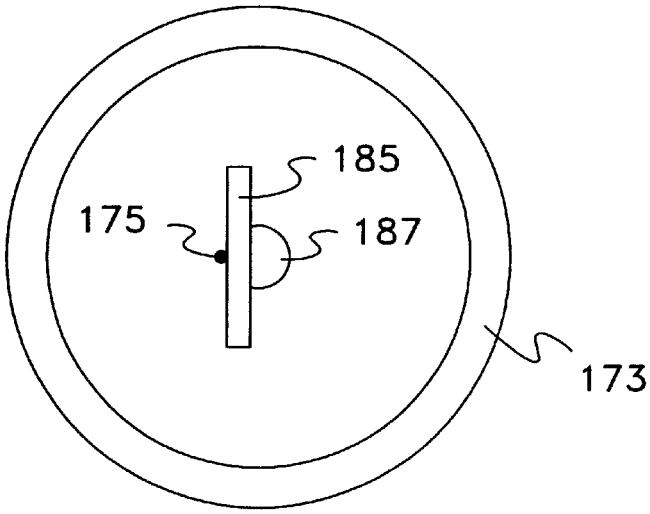
FIG. 18 is a top view of a portion of the apparatus in FIG. 17.

With reference to FIGS. 17 and 18, an apparatus 171 is shown in which the electric field required to breakdown a gas may be measured. A cylindrical quartz tube 173 is adapted to be pressurized with a gas and a fiber 175 is positioned inside the quartz tube 173 to enhance the fields applied to breakdown the gas. A rectangular resonant microwave cavity 177 includes an electric field probe 179 disposed therein to measure the field in the region under test. The probe 179 is connected to a measurement device 181. An adjustable tuner 183 is positioned inside the cavity 177. Accordingly, both the amount of microwave power and the Q of the cavity can be adjusted to set a desired E field. The fiber 175 is positioned on a quartz substrate 185 (i.e. the same material as the bulb wall). The substrate is mounted on a quartz rod 187 and inserted into the quartz tube 173. The tube 173 passes through the cavity 177 such that microwave energy can be applied to the gas inside the tube 173. The fiber 175 is aligned along the field lines. The probe 179 is positioned in the cavity 177 such the measured E field at the probe position corresponds to the E field applied to the pressurized gas at the position of the quartz tube 173. In the illustrated apparatus, for example, the tube 173 is centered a distance of ¼ wavelength from the end of the cavity 177 and the probe 179 is positioned a distance of ¾ wavelength from the end of the cavity 177. The gas type and pressure may be varied within the tube 173 and the breakdown delay time may be measured for different pressures and applied field strengths to characterize the enhancement provided by the fiber 175.

Without being limited to theory, it is believed that the use of SiC for the fiber(s) provides various mechanical advantages due to the strength of the material, the ease of conformity with curved surfaces (e.g. the bulb wall), and the relative inertness of the material next to hot quartz bulb walls. The room temperature resistivity of SiC ranges from a few ohm·cm to $10^3$ ohm·cm, depending on the grade of the SiC. One explanation for longer delay times may be the time it takes for the SiC to increase in temperature to a temperature where the resistance is reduced. For example, at 1000° C. the resistivity of SiC drops about an order of magnitude or more relative to room temperature. At some point, sufficient current flow takes place to charge the tips of the fiber and produce high electric fields. It is thus believed that increasing the conductivity of the fibers at room temperature reduces the delay time.

In one example which illustrates the principles of the invention, an 8 micron diameter SiC fiber about 3 mm long is coated with 0.2 micron of Pt by electron beam evaporation. Approximately 180 degrees of the fiber circumference is coated. Other methods of bonding the platinum to the silicon carbide or infiltrating the silicon carbide with platinum may be used to create the desired combination of the conductive and semi-conductive materials. Bulk platinum metal has a resistivity of $10.6\times10^{-6}$ ohm·cm at room temperature and it therefore dominates the fiber resistance, reducing it by about 10 orders of magnitude. The 8 micron, 3 mm long SiC fiber is believed to have a relatively high resistance at room temperature, while the Pt coated SiC fiber is believed to have a much lower resistance. While not necessarily low absolute resistance, the Pt coated SiC fiber has sufficiently low resistance at room temperature to improve the starting performance and provide low delay times. At 2,300 Torr Xe (with no $Kr_{85}$), breakdown of the gas in the presence of the fiber igniter occurred at a measured $1.8\times10^5$ V/m applied field with less than 0.4 ms delay. As discussed in detail below, such low delay times may be important to the useful life of the fiber. Those skilled in the art will appreciate that it is impractical to attempt to breakdown 2,300 Torr Xe in the illustrated apparatus without the aid of the present invention. However, without the fiber present, 200 Torr of Xenon broke down at a measured $4\times10^5$ V/m applied field. Thus the Pt coated SiC fiber allows ignition of greater than ten times the Xe pressure with less than one half of the applied field.

Figure 19:
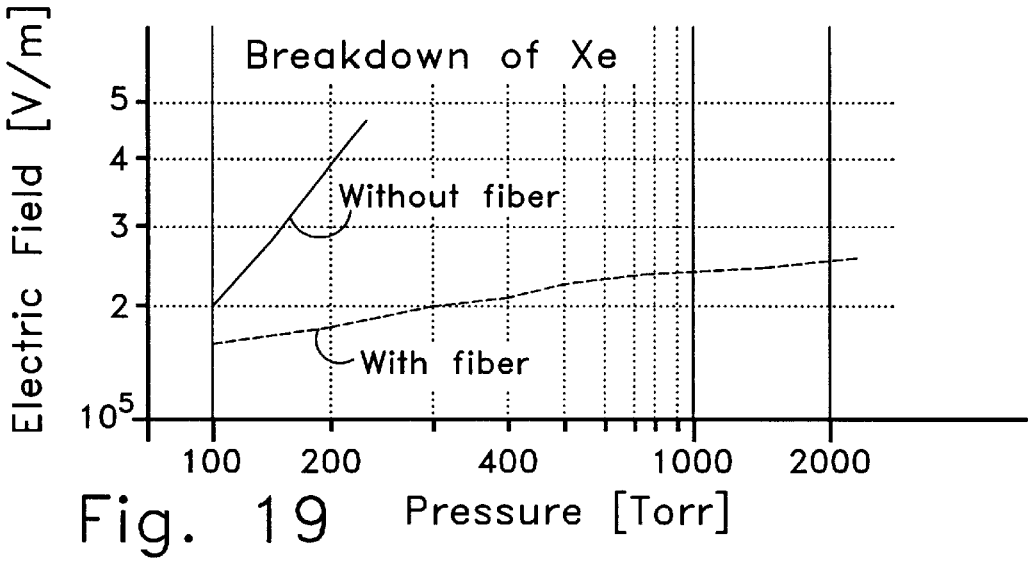
FIG. 19 is a graph of electric field strength versus pressure showing the field strengths required for breakdown of xenon with and without a fiber igniter of the present invention.
Figure 20:
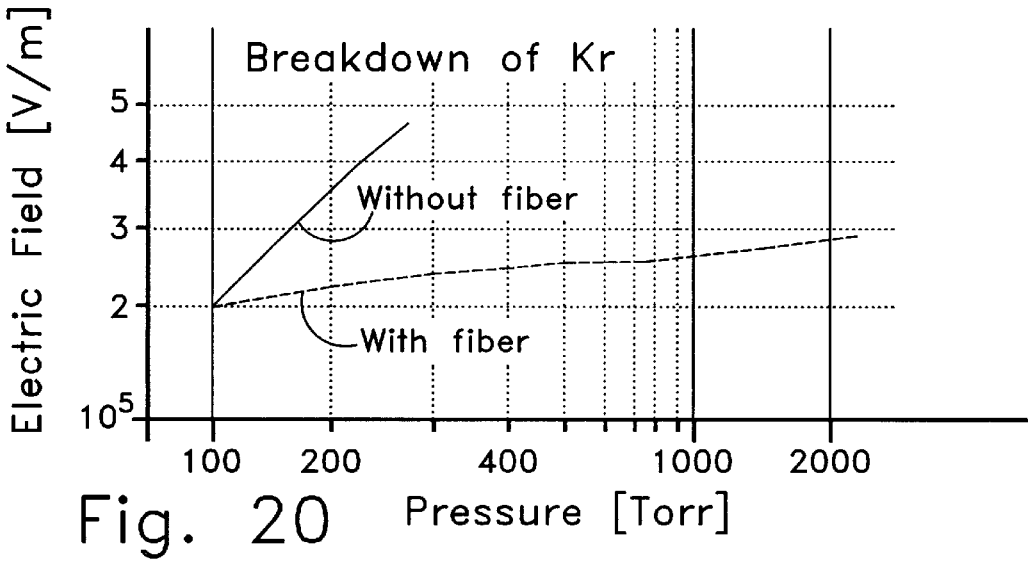
FIG. 20 is a graph of electric field strength versus pressure showing the field strengths required for breakdown of krypton with and without a fiber igniter of the present invention.
Figure 21:
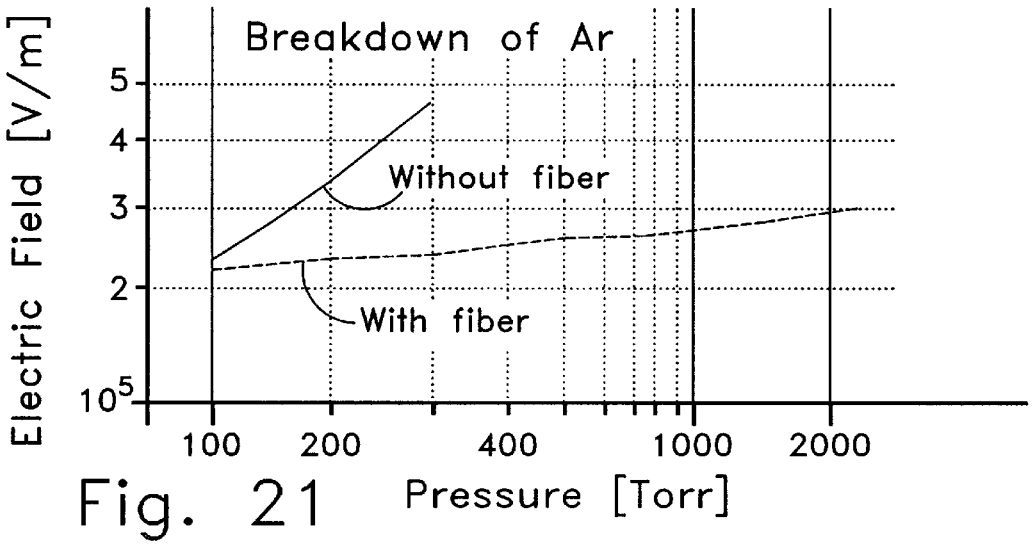
FIG. 21 is a graph of electric field strength versus pressure showing the field strengths required for breakdown of argon with and without a fiber igniter of the present invention.

With reference to FIG. 19, comparative data is shown for breakdown of xenon gas at various pressures with and without the 3 mm long Pt coated SiC fiber. As is apparent from the graph, the presence of the fiber significantly enhances the breakdown of the gas. Similar results are apparent from the graphs of FIGS. 20 and 21, for krypton and argon, respectively.

Depending on the application, the conductivity of the fiber may be more or less important. For example, in a microwave excited electrodeless lamp, the fiber should be sufficiently resistive at the operating temperature to de-couple from the fields applied to the plasma at steady state. In accordance with a present aspect of the invention, the coating and/or infiltration may be adjusted to provide more or less resistance as needed. For example, the resistance may be increased by reducing the thickness or amount of the coating. For a particular application, a suitable amount of resistance may be determined where the field enhancement is high during starting without significant coupling during steady state operation.

Examples of Single Fiber Starting Aids in Operating Lamps

An illustrative example is as follows. A 13 mm spherical bulb is filled with 26 mg S, 600 Torr Xe, and a small amount of $Kr_{85}$ (e.g. equivalent to about 0.06 microcuries). A 10 micron diameter graphite fiber having a length of 20 mm is positioned on the inside bulb surface and coated with 2 layers of $SiO_2$ using the above-referenced preferred recipe. The fiber is positioned within the bulb such that when the bulb is placed in the microwave cavity of a LightDrive® 1000 microwave lamp (made by Fusion Lighting, Inc., Rockville, Md.), the fiber is aligned with the applied E field. With the fiber so aligned, the lamp ignites with a measured magnetron current of approximately 100 mA (corresponding to approximately 250 W of microwave power). When the fiber is not so aligned, the lamp requires increased power to ignite.

By comparison, the same bulb without a fiber igniter, when filled with 50 Torr Xe and approximately 0.06 microcuries $Kr_{85}$ requires 275 mA of magnetron current (corresponding to about 850 W of microwave power) to ignite the lamp. Thus, the addition of the graphite fiber allows a greater than ten fold increase in Xe pressure with reduced starting power.

In a similarly configured lamp (600 Torr Xe) utilizing a 20 mm length of Mo fiber having a 15 micron diameter and the fiber aligned with the E field, the lamp ignited with a measured current of 150 mA (about 450 W of microwave power). In another similarly configured lamp (600 Torr Xe) utilizing a 20 mm length of Pt fiber having a 25 micron diameter and the fiber aligned with the E field, the lamp ignited with a measured current of 250 mA (about 750 W of microwave power). Molybdenum may be a good fiber material in many applications because it is the material of choice for feed through seals in lamps.

Another illustrative example is as follows. A 35 mm spherical bulb is filled with 23 mg S and 100 Torr $SO_2$. A 10 micron diameter graphite fiber having a length of 20 mm is positioned on the inside bulb surface and coated with 2 layers of $SiO_2$ using the above-referenced preferred recipe. The fiber is positioned within the bulb such that when the bulb is placed in the microwave cavity of a LightDrive® 1000 microwave lamp (made by Fusion Lighting, Inc., Rockville, Md.), the fiber is aligned with the applied E field. With the fiber so aligned, the lamp ignites with a measured current of approximately 350 mA (about 1100 W of microwave power). In a similarly configured bulb filled only with 600 Torr $SO_2$, the lamp ignites with a measured current of 800 mA (estimated to be about 2500 W of microwave power). Depending on the operating temperature of the lamp, graphite may be less desirable for certain applications because it reacts with $SiO_2$ at high temperatures.

Another illustrative example is as follows. A 35 mm spherical bulb is filled with 300 Torr $SO_2$. A 14 micron diameter SiC fiber having a length of 20 mm is positioned on the inside bulb surface and coated with 2 layers of $SiO_2$ using the above-referenced preferred recipe. The fiber is positioned within the bulb such that when the bulb is placed in the microwave cavity of a LightDrive® 1000 microwave lamp (made by Fusion Lighting, Inc., Rockville, Md.), the fiber is aligned with the applied E field. With the fiber so aligned, the lamp ignites with a measured current of approximately 350 mA (about 1100 W of microwave power). In a similarly configured bulb filled with 600 Torr SO2, the lamp ignites with a measured current of 800 mA (estimated to be about 2500 W of microwave power). It is estimated that the E field enhancement factor for SiC is about 20–30.

Without being limited to theory of operation, it is believed that a fiber made from a semi-conductor such as SiC may provide advantages over fibers made from conductors such as tantalum during hot re-strike of the lamp. Resistivity of a material generally has a dependence on the temperature of the material. Most metals have a resistivity which increases as temperature increases, which may degrade the field enhancing performance of a fiber made from metal during hot re-strike. SiC, however, has a resistivity which decreases as temperature increases, which may improve the field enhancing performance of a fiber made from SiC during hot re-strike.

A sulfur lamp utilizing a high pressure (e.g. 600 Torr) xenon buffer gas and a single SiC fiber has been re-ignited after more than 8000 hours of operation, with limited on/off cycling. No visible changes to the SiC fiber are apparent, indicating that the fiber does not react with the fill or the quartz under normal lamp operating conditions.

Effect of Fiber Length on Delay Time

In the following examples, the bulb fill is 600 Torr xenon with a small amount of $Kr_{85}$. In each case, a single SiC fiber having a diameter of 14 microns is utilized.

| Fiber Length | Delay |
|---|---|
| 5 mm | 292 ms–314 ms |
| 20 mm | 93 ms–99 ms |
| 30 mm | 53 ms–74 ms |

While the inventors do not wish to be limited by theory of operation, it is believed that excessive delay time (e.g. >50 ms) may be a factor in limiting useful lifetime of fibers, especially SiC fibers which have a relatively high heating rate. The heating rate of SiC is estimated to be about 10–100° C./ms, but in this application is believed to be much less due to heat transfer to the bulb wall. If the temperature of the fiber reaches above 800° C., the fiber visibly glows.

Prolonged RF heating causes the SiC fiber to break up and eventually (e.g. after several hundred to one thousand cycles) the fiber fails to enhance the starting field. For longer life applications it may therefore be desirable to reduce the delay time to prevent the fiber from being damaged by excessive ohmic heating.

Without being limited by theory of operation, it is believed that a distinction may be drawn between the desirable characteristics of the fiber during delay/run up time and during steady state operation. During delay and run-up time, the sufficient conductivity of the fiber increases the electric field enhancement, but appreciable amounts of energy may couple to the fiber which eventually degrades the ability of the fiber to enhance ignition. Excessive delay time may be the most significant factor in degradation of the fiber. However, with multiple fibers and other suitable measures (e.g. small amounts of Ar and/or $Kr_{85}$), delay times are reduced and several thousand starting cycles may be obtained (some examples have over 10,000 cycles). A relatively resistive fiber may be preferred as long as the fiber provides sufficient field enhancement. During steady state operation, the relatively high resistance of the fiber as compared to the plasma results in little energy being coupled to the fiber. The fiber does not over heat because the fiber readily dissipates heat to the bulb wall.

Examples of Multiple Fiber Starting Aids

A six inch long cylindrical shaped bulb has an 11 mm outer diameter and a pinched middle section separating two discharge chambers. Two SiC fibers, each having a diameter of 14 microns and a length of 25 mm, are positioned on the inner bulb wall, parallel to the lengthwise axis of the bulb and approximately centered in each chamber (e.g. see FIG. 9). The bulb is filled with 500 Torr Xenon. The fibers are covered with two layers of protective sol-gel coating using the above indicated preferred recipe.

The fill is excited, for example, by a lamp apparatus similar to that described in U.S. Pat. No. 5,686,793. The fill ignites reliably in lamp system model nos. F300, HP-6, and F500, commercially available from Fusion UV Systems, Gaithersburg, Md.

Another example is as follows. A ten inch long cylindrical shaped bulb has an 18 mm outer diameter. Four SiC fibers, each having a diameter of 14 microns and a length of 25 mm, are positioned on the inner bulb wall (e.g. parallel to the lengthwise axis of the bulb). The bulb is filled with 1530 Torr Xenon and chlorine gas. The fibers are covered with two layers of protective $SiO_2$ coating using the above indicated preferred sol-gel recipe. The fill ignites reliably in lamp system model nos. F450 and F600, commercially available from Fusion UV Systems, Gaithersburg, Md. A first alternative is similarly configured except for utilizing four graphite fibers, each having a diameter of 10 microns and a length of 25 mm. Another alternative is similarly configured except for using four Pt fibers, each having a diameter of 25 microns and a length of 25 mm.

Cl may diffuse through the sol gel film covering and react with SiC, graphite, Mo, and W. It is further believed that micro-cracks may form at the corners of the film-fiber-quartz tri-junction. Accordingly, the thin film coating may not sufficiently protect the fibers against the highly reactive Cl plasma over many starting cycles. No reaction is observed with a sol gel film covering Pt, but long delay times degrade the coating and Pt after several ignitions (because the fibers get very hot if the delay time is long). Alternative coating materials (e.g. alumina) may be preferred for fills which include Cl.

Other examples of linear cylindrical bulbs using multiple fibers and various pressures of xenon are as follows:

| Bulb type (ID × OD) | Xe Pressure | Fiber amount |
|---|---|---|
| 13 mm × 15 mm pinched tube | 1700 Torr | 4.8 mg |
| 15 mm × 18 mm straight tube | 1530 Torr | 4.8 mg |
| 15 mm × 18 mm straight tube | 1700 Torr | 4.8 mg |
| 15 mm × 18 mm straight tube | 2000 Torr | 4.8 mg |
| 13 mm × 15 mm pinched tube | 1700 Torr | 2.4 mg |
| 13 mm × 15 mm pinched tube | 1700 Torr | 1.2 mg |

In each of the above examples, the individual fibers are 14 microns in diameter and 25 mm long, Hi-Nicalon SiC fibers. Multiple fibers totaling to the indicated fiber amount in mg are disposed inside the tube and concentrated at the ends of the linear bulb, the fibers being semi-randomly distributed in each end (e.g. see FIG. 15). During operation, the ends of the bulb are positioned in regions of high fields. The fibers are coated with two layers of sol-gel deposited silicon dioxide. For each of the above examples, reliable ignition of the fill is achieved. When the fiber amount is reduced to about 0.4 mg or less of the fibers, ignition may still occur but not reliably.

Effect of Multiple Fibers on Delay Time

In the following examples, the bulb fill is 600 Torr xenon with a small amount of $Kr_{85}$. All of the fibers are SiC having a diameter of 14 microns.

| Fiber length | Number of Fibers | Delay |
|---|---|---|
| 3 mm | 100–200 | 29 ms–80 ms |

As noted above, excessive delay time (e.g. >50 ms) may be a factor in limiting useful lifetime of fibers, especially SiC fibers which have a relatively high heating rate. With numerous short fibers, it is believed that multiple sites are excited which reduces delay time because a relatively large volume undergoes avalanche breakdown all at once. Utilizing multiple fibers significantly reduces the delay time and improves the useful life time of the bulb by increasing the number of starting cycles. For example, for a S—Xe bulb the number of cycles is increased to over several thousand cycles by using multiple short SiC fibers, a factor of 3–4 greater than a single long SiC fiber.

Moreover, it is believed that numerous short Pt coated SiC fibers may work even better than uncoated SiC fibers for reducing the delay time. The use of 3 mm long, 8 micron diameter fibers plated with 0.2 microns Pt should reduce the 29 ms delay time even further and allow ignition of xenon gas at pressures in excess of 2000 Torr. The fibers may be placed at random orientations on the interior bulb wall, but preferably in the region of high field strengths during ignition. For example, tens or hundreds of fibers can be placed in a one square cm area. The fibers may be further protected by one or more layers of silicon dioxide using the above described sol-gel recipe.

Example of Lamp with SiC Whiskers

An illustrative example is as follows. A 35 mm spherical bulb is filled with 26 mg S, 600 Torr Xe, and a small amount of $Kr_{85}$. SiC whiskers having diameters ranging from between 0.4 microns and 0.7 microns and lengths ranging between 0.05 and 2 mm are arranged in bunches and randomly distributed on the inside bulb surface. The whiskers are coated with 1 layer of $SiO_2$ using the above-referenced preferred recipe. The bulb is placed in the microwave cavity of a LightDrive® 1000 microwave lamp (made by Fusion Lighting, Inc., Rockville, Md.). With the SiC whiskers, the lamp ignites with a measured current of approximately 320 mA (about 1000 W of microwave power).

Noble Gas Mixture

To further reduce start times and the corresponding stresses on the fiber and RF source, it may be desirable to add a small amount of a lower atomic number inert gas (e.g. argon, neon, or helium) to the fill. The benefits of such a gas mixture are described in detail in PCT Publication No. WO 99/08865.

An illustrative example is as follows. A 35 mm spherical bulb filled with 26 mg S, 600 Torr Xe, a small amount of $Kr_{85}$, and 10 Torr Ar. SiC whiskers having diameters ranging from between 0.4 microns and 0.7 microns and lengths ranging between 0.05 and 2 mm are arranged in bunches and randomly distributed on the inside bulb surface. The whiskers are coated with 1 layer of $SiO_2$ using the above-referenced preferred recipe. The bulb is placed in the microwave cavity of a LightDrive® 1000 microwave lamp (made by Fusion Lighting, Inc., Rockville, Md.). With the SiC whiskers, the lamp ignites with a measured current of approximately 320 mA (about 1000 W of microwave power). The delay time is less than half of the delay time for the above example without the Ar.

Another example is as follows. A 35 mm spherical bulb filled with 26 mg S, 600 Torr Xe, and a small amount of $Kr_{85}$. A single SiC fiber 14 microns in diameter and 25 mm long is disposed on the inside bulb wall and covered with 2 layers of sol-gel deposited silicon dioxide. The delay time is about 100 ms. With the addition of 10 Torr Ar, the delay time is less than 25 ms. Accordingly, the addition of a small amount of argon significantly reduces the delay time.

The above examples are illustrative only and not limiting. Although the examples noted above have been described in connection with microwave excitation, other excitation techniques and structures for coupling to electrodeless bulbs will also benefit from the starting aid(s) of the present invention. For example, these other coupling structures include inductive coupling, capacitive coupling, and travelling wave launchers.

For simplicity of manufacture, it is contemplated that a particular bulb will have the same type of fiber (e.g. same material, same diameter) used as the starting aid. However, if necessary or desirable for a particular application, the above described fiber materials and/or configurations may be combined. For example, patches of randomly distributed SiC whiskers may be utilized together with a long SiC fiber aligned with the electric field. Another example is a combination of fibers having different materials and/or diameters. Other combinations may likewise be useful.

The invention may be useful in other plasma processing applications where breakdown is difficult, particularly those applications where internal electrodes are less desirable.

While the invention has been described in connection with what is presently considered to be the preferred embodiments, it is to be understood that the invention is not limited to the disclosed embodiments, but on the contrary, is intended to cover various modifications and equivalent arrangements included within the spirit and scope of the inventions.

What is claimed is:

1. A discharge lamp bulb comprising a light transmissive envelope including a fill comprising gas and at least one fiber disposed on a wall of the envelope, wherein the fibers have a thickness of less than 100 microns and provide an enhancement of a field when a field is applied to breakdown the fill and excite the fill to emit light.

2. The discharge lamp bulb as recited in claim 1, wherein at least one fiber disposed on the wall of the envelope is made from a conductive material.

3. A discharge lamp bulb as recited in claim 2 comprising:

at least one layer that binds the fibers to an interior wall of the envelope and inhibits interaction between the fibers and the fill.

4. The discharge lamp bulb as recited in claim 1, wherein at least one fiber disposed on the wall of the envelope is made from a semi-conductive material.

5. A discharge lamp bulb as recited in claim 4 comprising:

at least one layer that binds the fibers to an interior wall of the envelope and inhibits interaction between the fibers and the fill.

6. The discharge lamp bulb as recited in claim 1, wherein at least one fiber disposed on the wall of the envelope is made from a combination of conductive and semi-conductive materials.

7. A discharge lamp bulb as recited in claim 6 comprising:

at least one layer that binds the fibers to an interior wall of the envelope and inhibits interaction between the fibers and the fill.

8. The discharge lamp bulb as recited in claim 1, wherein the fiber is sufficiently flexible to readily conform to the wall of the envelope.

9. A discharge lamp bulb as recited in claim 8 comprising:

at least one layer that binds the fibers to an interior wall of the envelope and inhibits interaction between the fibers and the fill.

10. The discharge lamp bulb as recited in claim 1, wherein at least one fiber disposed on the wall of the envelope has a thickness of less than 25 microns.

11. A discharge lamp bulb as recited in claim 10 comprising:

at least one layer that binds the fibers to an interior wall of the envelope and inhibits interaction between the fibers and the fill.

12. The discharge lamp bulb as recited in claim 1, wherein at least one fiber disposed on the wall of the envelope has a thickness of less than 10 microns.

13. A discharge lamp bulb as recited in claim 12 comprising:

at least one layer that binds the fibers to an interior wall of the envelope and inhibits interaction between the fibers and the fill.

14. The discharge lamp bulb as recited in claim 1, wherein at least one fiber disposed on the wall of the envelope has a thickness of less than 1 micron.

15. A discharge lamp bulb as recited in claim 14 comprising:

at least one layer that binds the fibers to an interior wall of the envelope and inhibits interaction between the fibers and the fill.

16. The discharge lamp bulb as recited in claim 1, wherein each of the fibers has a circular cross section and wherein the thickness of the fiber corresponds to a diameter of the fiber.

17. A discharge lamp bulb as recited in claim 16 comprising:

at least one layer that binds the fibers to an interior wall of the envelope and inhibits interaction between the fibers and the fill.

18. The discharge lamp bulb as recited in claim 1, wherein the lamp bulb is electrodeless.

19. A discharge lamp bulb as recited in claim 18 comprising:

at least one layer that binds the fibers to an interior wall of the envelope and inhibits interaction between the fibers and the fill.

20. The discharge lamp bulb as recited in claim 1, wherein the lamp bulb includes internal electrodes.

21. A discharge lamp bulb as recited in claim 20 comprising:

at least one layer that binds the fibers to an interior wall of the envelope and inhibits interaction between the fibers and the fill.

22. The discharge lamp bulb as recited in claim 1, wherein at least one fiber disposed on the wall of the envelope is made from a material selected from the group of materials comprising carbon, silicon carbide, aluminum, tantalum, molybdenum, platinum, and tungsten.

23. A discharge lamp bulb as recited in claim 22 comprising:

at least one layer that binds the fibers to an interior wall of the envelope and inhibits interaction between the fibers and the fill.

24. The discharge lamp bulb as recited in claim 1, wherein at least one fiber disposed on the wall of the envelope is made from silicon carbide coated with platinum.

25. A discharge lamp bulb as recited in claim 24 comprising:

at least one layer that binds the fibers to an interior wall of the envelope and inhibits interaction between the fibers and the fill.

26. The discharge lamp bulb as recited in claim 1, wherein the fibers comprise a plurality of closely spaced parallel fibers.

27. A discharge lamp bulb as recited in claim 26 comprising:

at least one layer that binds the fibers to an interior wall of the envelope and inhibits interaction between the fibers and the fill.

28. The discharge lamp bulb as recited in claim 1, wherein the fibers comprise a plurality of randomly distributed fibers.

29. A discharge lamp bulb as recited in claim 28 comprising:

at least one layer that binds the fibers to an interior wall of the envelope and inhibits interaction between the fibers and the fill.

30. The discharge lamp bulb as recited in claim 28, wherein each of the fibers is about 3 mm long or less.

31. A discharge lamp bulb as recited in claim 30 comprising:

at least one layer that binds the fibers to an interior wall of the envelope and inhibits interaction between the fibers and the fill.

32. The discharge lamp bulb as recited in claim 1, wherein the fibers comprise a patch of silicon carbide whiskers.

33. A discharge lamp bulb as recited in claim 32 comprising:

at least one layer that binds the fibers to an interior wall of the envelope and inhibits interaction between the fibers and the fill.

34. The discharge lamp bulb as recited in claim 1, wherein the fibers are disposed on an inside surface of the light transmissive envelope and wherein the fibers are covered with a protective material.

35. The discharge lamp bulb as recited in claim 34, wherein the protective material comprises a silicon dioxide coating less than 2 microns thick.

36. A discharge lamp bulb as recited in claim 35 comprising:

at least one layer that binds the fibers to an interior wall of the envelope and inhibits interaction between the fibers and the fill.

37. A discharge lamp bulb as recited in claim 34 comprising:

at least one layer that binds the fibers to an interior wall of the envelope and inhibits interaction between the fibers and the fill.

38. A discharge lamp bulb as recited in claim 1 comprising:

at least one layer that binds the fibers to an interior wall of the envelope and inhibits interaction between the fibers and the fill.

39. A discharge apparatus, comprising:

a light transmissive container having a light emitting fill disposed therein;

a coupling structure adapted to couple energy to the fill in the container;

a high frequency source connected to the coupling structure; and at least one fiber disposed on a wall of the container, wherein each of the fibers has a thickness of less than 100 microns, wherein the fibers are made from a conductive material, a semi-conductive material, or a combination of conductive and semi-conductive materials.

40. The discharge apparatus as recited in claim 39, wherein the fibers are sufficiently flexible to readily conform to the wall of the container.

41. A discharge apparatus as recited in claim 40, comprising:

at least one layer that binds the fibers to an interior wall of the envelope and inhibits interaction between the fibers and the fill.

42. The discharge apparatus as recited in claim 34, wherein the fill includes an inert gas and wherein the fibers provide an enhancement of a field the field and excite the fill to emit light.

43. A discharge apparatus as recited in claim 42, comprising:

at least one layer that binds the fibers to an interior wall of the envelope and inhibits interaction between the fibers and the fill.

44. The discharge apparatus as recited in claim 39, wherein the fill comprises a noble gas at a pressure greater than 300 Torr, the field applied to the container during starting is less than $4\times10^5$ V/m, and wherein the applied field is effective to cause a breakdown of the noble gas.

45. A discharge apparatus as recited in claim 44, comprising:

at least one layer that binds the fibers to an interior wall of the envelope and inhibits interaction between the fibers and the fill.

46. The discharge apparatus as recited in claim 39, wherein the high frequency source comprises a magnetron and wherein the coupling structure comprises a waveguide connected to a microwave cavity.

47. A discharge apparatus as recited in claim 46, comprising:

at least one layer that binds the fibers to an interior wall of the envelope and inhibits interaction between the fibers and the fill.

48. The discharge apparatus as recited in claim 39, wherein at least one fiber is aligned with the electric field during starting.

49. A discharge apparatus as recited in claim 48, comprising:

at least one layer that binds the fibers to an interior wall of the envelope and inhibits interaction between the fibers and the fill.

50. The discharge apparatus as recited in claims 39, wherein the apparatus comprises a lamp and wherein the container comprises a sealed electrodeless lamp bulb.

51. A discharge apparatus as recited in claim 50, comprising:

at least one layer that binds the fibers to an interior wall of the envelope and inhibits interaction between the fibers and the fill.

52. The discharge lamp as recited in claim 50, wherein the electrodeless lamp bulb comprises a linear bulb and wherein the fibers comprise a plurality of fibers concentrated at respective ends of the linear bulb.

53. A discharge apparatus as recited in claim 52, comprising:

at least one layer that binds the fibers to an interior wall of the envelope and inhibits interaction between the fibers and the fill.

54. A discharge apparatus as recited in claim 39, comprising:

at least one layer that binds the fibers to an interior wall of the envelope and inhibits interaction between the fibers and the fill.

55. An electrodeless discharge lamp, comprising:

a light transmissive envelope having a light emitting fill disposed therein;

a coupling structure adapted to couple energy to the fill in the envelope;

a high frequency source connected to the coupling structure;

at least one silicon carbide fiber disposed on an inside wall of the envelope, each of the silicon carbide fibers having a thickness of less than 25 microns; and a material covering the silicon carbide fibers, wherein the material inhibits a reaction between the fill and the fibers.

56. The discharge lamp as recited in claim 55, wherein the envelope comprises an electrodeless linear bulb and wherein the fibers comprise a plurality of silicon carbide fibers concentrated at respective ends of the linear bulb.

57. An electrodeless discharge lamp as recited in claim 56 wherein:

the fill comprises a gas; and the fibers provide an enhancement of field when a field is applied to breakdown the fill and excite the fill to emit the light and the material covering the silicon carbide fibers binds the silicon carbide fibers to an interior wall of the envelope.

58. The discharge lamp as recited in claim 55, further comprising a coating of platinum on the silicon carbide fibers.

59. An electrodeless discharge lamp as recited in claim 58 wherein:

the fill comprises a gas; and the fibers provide an enhancement of field when a field is applied to breakdown the fill and excite the fill to emit the light and the material covering the silicon carbide fibers binds the silicon fibers to an interior wall of the envelope.

60. The discharge lamp as recited in claim 55, wherein the fibers comprise a plurality of closely spaced parallel silicon carbide fibers.

61. An electrodeless discharge lamp as recited in claim 60 wherein:

the fill comprises a gas; and the fibers provide an enhancement of field when a field is applied to breakdown the and excite the fill to emit the light and the material covering the silicon carbide fibers binds the silicon fibers to an interior wall of the envelope.

62. The discharge lamp as recited in claim 55, wherein the fibers comprise a plurality of randomly distributed silicon carbide fibers.

63. The discharge lamp as recited in claim 62, wherein each of the silicon carbide fibers is about 3 mm long or less.

64. An electrodeless discharge lamp as recited in claim 63 wherein:

the fill comprises a gas; and the fibers provide an enhancement of field when a field is applied to breakdown the fill and excite the fill to emit the light and the material covering the silicon carbide fibers binds the silicon carbide fibers to an interior wall of the envelope.

65. An electrodeless discharge lamp as recited in claim 62 wherein:

the fill comprises a gas; and the fibers provide an enhancement of field when a field is applied to breakdown the fill and excite the fill to emit the light and the material covering the silicon carbide fibers binds the silicon fibers to an interior wall of the envelope.

66. The discharge lamp as recited in claim 55, wherein the fibers comprise a patch of silicon carbide whiskers.

67. An electrodeless discharge lamp as recited in claim 66 wherein:

the fill comprises a gas; and the fibers provide an enhancement of field when a field is applied to breakdown the fill and excite the fill to emit the light and the material covering the silicon carbide whiskers binds the silicon carbide whiskers to an interior wall of the envelope.

68. The discharge lamp as recited in claim 55, wherein the material comprises a silicon dioxide coating less than 2 microns thick.

69. An electrodeless discharge lamp as recited in claim 68 wherein:

the fill comprises a gas; and the fibers provide an enhancement of field when a field is applied to breakdown the fill and excite the fill to emit the light and the material covering the silicon dioxide fibers binds the silicon dioxide fibers to an interior wall of the envelope.

70. The discharge apparatus as recited in claim 55, wherein the envelope encloses an inert gas and wherein the silicon carbide fibers provide an enhancement of a field when a field is applied to breakdown the fill and excite the fill to emit light.

71. An electrodeless discharge lamp as recited in claim 70 wherein:

the material covering the silicon carbide fibers binds the silicon carbide fibers to an interior wall of the envelope.

72. The discharge lamp as recited in claim 55, wherein the fill comprises a noble gas at a pressure greater than 300 Torr, the field applied to the envelope during starting is less than $4\times10^5$ V/m, and wherein the applied field is effective to cause a breakdown of the noble gas.

73. An electrodeless discharge lamp as recited in claim 72 wherein:

the fill comprises a gas; and the fibers provide an enhancement of field when a field is applied to breakdown the fill and excite the fill to emit the light and the material covering the silicon carbide fibers binds the silicon carbide fibers to an interior wall of the envelope.

74. The discharge lamp as recited in claim 55, wherein the fill comprises a noble gas at a pressure greater than 500 Torr, the field applied to the envelope during starting is less than $3\times10^5$ V/m, and wherein the applied field is effective to cause a breakdown of the noble gas.

75. An electrodeless discharge lamp as recited in claim 74 wherein:

the fill comprises a gas; and the fibers provide an enhancement of field when a field is applied to breakdown the fill and excite the fill to emit the light and the material covering the silicon carbide fibers binds the silicon carbide fibers to an interior wall of the envelope.

76. An electrodeless discharge lamp as recited in claim 55 wherein:

the fill comprises a gas; and the fibers provide an enhancement of field when a field is applied to breakdown the fill and excite the fill to emit the light and the material covering the silicon fibers binds the silicon fibers to an interior wall of the envelope.

* * * * *